US005571537A

United States Patent [19]

Geus et al.

[11] Patent Number: 5,571,537

[45] Date of Patent: Nov. 5, 1996

[54] STATIONARY-PRESSURE APPARATUS FOR PRODUCING SPUN-BOND WEB

[75] Inventors: Hans G. Geus, Niederkassel; Detlef Frey, Troisdorf; Bernd Kunze, Hennef, all of Germany

[73] Assignee: Reifenhauser GmbH & Co. Maschinenfabrik, Troisdorf, Germany

[21] Appl. No.: 425,113

[22] Filed: Apr. 21, 1995

[30] Foreign Application Priority Data

Apr. 23, 1994 [DE] Germany ..... 44 14 277.3

[51] Int. Cl.[6] ..... D01D 5/092; D01D 5/12

[52] U.S. Cl. ..... 425/72.2; 264/210.7; 264/210.8; 264/211.14; 264/555; 425/66; 425/83.1

[58] Field of Search ..... 425/66, 72.1, 72.2, 425/80.1, 83.1; 264/555, 211.14, 210.8, 211.15, 211.13, 210.7, 177.17, 177.19

[56] References Cited

U.S. PATENT DOCUMENTS

| | | | |
|---|---|---|---|
| 3,049,755 | 8/1962 | Aizawa et al. | 425/66 |
| 4,578,134 | 3/1986 | Hartmann | 264/211.15 |
| 4,627,811 | 12/1986 | Greiser et al. | 425/72.2 |
| 4,692,106 | 9/1987 | Grabowski et al. | 425/66 |
| 4,813,864 | 3/1989 | Balk | 425/72.2 |
| 4,820,459 | 4/1989 | Reifenhauser | 425/66 |
| 4,838,774 | 6/1989 | Balk | 425/72.2 |
| 4,847,035 | 6/1989 | Mente et al. | 264/210.8 |
| 5,034,182 | 7/1991 | Sze et al. | 264/555 |
| 5,141,699 | 8/1992 | Meyer et al. | 264/211.15 |
| 5,211,903 | 5/1993 | Reifenhauser | 425/72.2 |
| 5,336,071 | 8/1994 | Kobayashi et al. | 425/66 |
| 5,460,500 | 10/1995 | Geus et al. | 425/66 |

*Primary Examiner*—Jay H. Woo
*Assistant Examiner*—Duane S. Smith
*Attorney, Agent, or Firm*—Herbert Dubno

[57] ABSTRACT

Nonwoven spun-bond is produced by a stationary pressure apparatus in which the shaft below the spinneret has an inlet section followed by the downwardly converging intermediate section, a drawing section and a diffuser opening above the collecting belt through which air is drawn by a suction device. The process air velocity profile has an intersection point with the drawing value at the intermediate section and the distance between the intersection point and the spinneret is smaller than the distance between the intersection point and the bottom end of the drawing section.

7 Claims, 1 Drawing Sheet

STATIONARY-PRESSURE APPARATUS FOR PRODUCING SPUN-BOND WEB

FIELD OF THE INVENTION

Our present invention relates to an apparatus operating under the stationary-pressure principle with expansion and acceleration of the process air and drawing of the spun filament for use in the production of a nonwoven spun-bond web.

BACKGROUND OF THE INVENTION

In the production of nonwoven spun-bond webs, the apparatus can have a spinneret through which the thermoplastic synthetic resin filaments are forced, thereby forming a spun filament curtain which descends through a spinning and drawing shaft. The filament curtain is collected on a continuously movable receiving belt which is perforated or otherwise foraminous so that air can be drawn through this band by a suction device therebelow.

There are several systems which have been developed for the production of spun bond utilizing such an apparatus and the present invention is concerned with a system which can be described as a quiescent pressure or stationary pressure principle. The stationary pressure principle describes a process air system in which the process air is fed to the upstream end of the shaft at an inlet section in which a predetermined static pressure is maintained, i.e. the pressure air feed is proportioned to the air which passes downwardly through the shaft with the curtain so that the air in this portion of the shaft is practically static or at rest and the aforementioned static pressure and quiescent conditions are maintained.

The process air, of course, does pass downwardly through the shaft, accelerating in a convergent intermediate section below the inlet section before passing through the stretching section which can be of constant cross section and before finally emerging before a diffuser which flares outwardly and downwardly. The section below the belt also contributes to the draw upon filament and the movement of the air through the shaft. The stationary pressure principle with which the present invention is concerned can be contrasted with the driving jet principle in which nozzles are provided to generate high velocity jets which entrain the filaments downwardly.

The process air, of course, can also be referred to as cooling air and, in prior art systems utilizing the stationary pressure system, the process air is admitted transverse to the spun filament curtain in the inlet section of the spinning and drawing shaft.

The spinneret can be a perforated plate having an array of bores forming respective spinning nozzles and from which the spun filaments emerge. When reference is made herein to the contours of the shaft, it will be understood that these contours are as seen in a vertical section through the shaft in a plane perpendicular to the longitudinal dimension thereof and hence transverse to the horizontal longitudinal dimension of the curtain. The spinneret is customarily of rectangular configuration so that the array of orifices is elongated horizontally and hence the curtain itself, in a horizontal plane is elongated in a particular direction. The vertical section in which the contours of the shaft are defined is a vertical section perpendicular to this horizontal longitudinal dimension.

The apparatus of the foregoing type has been found to be highly effective in the production of spun bond but from the point of view of energy utilization can be improved. Indeed, we have found that it is possible to significantly improve the transfer coefficient, i.e. the quotient formed between the process air velocity and the spun filament velocity which corresponds to a constant drawing value averaged over all of the filaments of the spun filament curtain. This quotient generally is between 2.4 and 4 in conventional apparatus, i.e. the air speed is 2.4 to 4 times higher than the maximum spun filament velocity and thus its drawing value. The efficiency of the system is thus amenable to significant improvement.

OBJECTS OF THE INVENTION

It is, therefore, the principal object of the invention to provide an improved apparatus for the stationary pressure production of nonwoven spun bond, whereby the efficiency and, in conjunction therewith, the transfer coefficient can be improved.

Another object of this invention is to provide an apparatus for producing nonwoven spun bond whereby drawbacks of earlier systems are obviated.

SUMMARY OF THE INVENTION

These objects and others which will become apparent hereinafter can be achieved, surprisingly, with an apparatus for producing a nonwoven spun-bond web by the stationary pressure principle using expansion and acceleration of the process air and drawing of the spun filament. According to the invention the apparatus comprises:

- a spinneret producing a descending curtain of spun filaments;
- means forming a shaft enclosing the descending curtain of spun filaments below the spinneret;
- process-air supply means connected with said shaft for feeding process air thereto;
- a continuously moving foraminous receiving belt below the shaft for collecting the spun filaments and on which a nonwoven spun-bond web is formed; and
- a suction device below the belt for drawing air through the belt, the shaft having from top to bottom an inlet section of a given length and width and in which air is directed against the curtain of spun filament, a downwardly tapering intermediate section having a certain convergence angle, a stretching section connected to the intermediate section, and a downwardly flaring diffusor section connected to the stretching section, said process air is introduced into the inlet section and after an initial flow path in the shaft reaches a maximum velocity at the upstream end of the stretching section, said spun filaments achieve a constant drawing value just after the curtain emerges from the spinneret, a curve of the process air velocity plotted along the length of the shaft intersects a curve of the drawing value at an intersection point (S) substantially in a region of the intermediate section.

According to the invention, (a) a distance ($A_1$) of the intersection point (S) from the spinneret is smaller than a distance ($A_2$) from the intersection point (S) to a downstream end of the stretching section, (b) the convergence half angle ($\alpha$) of the intermediate section is 0.05° to 2°, (c) a width ($B_1$) of the spun filament curtain in the region of the inlet section is smaller than a width of the inlet section and preferably is smaller than a half-width ($B_2$)

thereof, say by a factor less than 0.7 so that $B_1<0.7B_2$, and (d) said shaft and process-air supply means being constructed and arranged so that the process air has a maximum velocity ($VL_{MAX}$) greater than the constant drawing value ($VF_a$) by a factor of 1.2 to 1.6 so that $VL_{MAX}$=(1.2 $VF_a$ to 1.6 $VF_a$).

The process-air velocity is here defined as an average value over the horizontal cross section of the spinning and drawing shaft.

Preferably, the spacing of the spun filaments in the spun filament curtain and hence the mutual spacing of the orifices of this spinneret is about 1.5 to 12 mm.

It has been found to be important to maintain a clear spacing between the walls bounding the shaft and the spun filament curtain.

For best results, the spacing of the intersection point from the spinneret is smaller by a factor of about 0.5 than the spacing of this intersection point from the lowermost end of the drawing section. It has also been found to be advantageous to provide the width of the spun filament curtain in the region of the inlet section to be smaller by a factor of about 0.3 than the width of the inlet section itself. Finally, we have found that it is of importance to the invention to provide that the pressure drop of the process air in the spinning and drawing shaft is in excess of 600 Pa and up to about 2500 Pa.

The invention is based upon our discovery that the spun filaments as they emerge form the spinneret and until they leave the stretching section should be entrained by the process air with a drawing force which is determined by the configuration of the apparatus and is characterized by the aforementioned intersection point between the velocity of the spun filament and the velocity of the process air. The combination of steps (a)–(c) significantly reduces the braking effect of the air and ensures a better transfer coefficient and hence a greater efficiency.

The improvement is even more pronounced when feature (d) applies, i.e. the process air system is so arranged that the maximum value of the process air velocity is greater than a factor of 1.2 to 1.6 than the constant drawing value of the spun filament, i.e. the spun filament speed. Corresponding dimensions can be readily obtained from simple tests.

BRIEF DESCRIPTION OF THE DRAWING

The above and other objects, features, and advantages will become more readily apparent from the following description, reference being made to the accompanying drawing in which.

SPECIFIC DESCRIPTION

Figure 2:
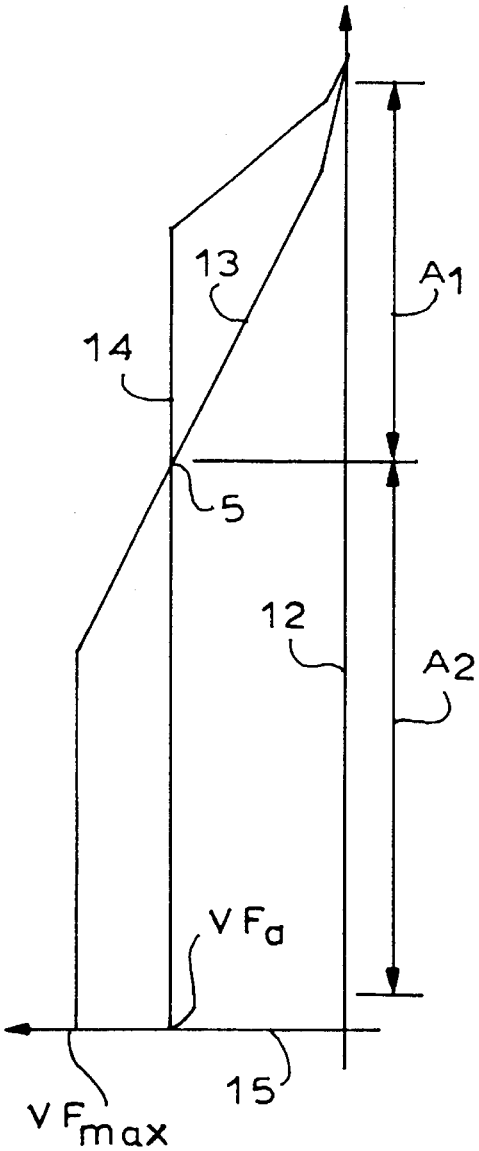
FIG. 2 is a graphic illustration of a principle of the invention.

As can be seen from FIG. 1, wherein only the important elements of the apparatus for producing a nonwoven spun-bond web 20 of thermoplastic filament has been shown, it can be seen that the apparatus 1 comprises a spinning and drawing shaft 4 disposed below a spinneret 2 from which the individual filaments 21 emerge from respective orifices and descend in a curtain 3.

Below the shaft 4, a continuously movable foraminous belt 5 is provided for collecting the filaments in the spun-bond web 20 with the assistance of a suction device represented only by the arrow 6, drawing air through the web and the belt and inducing a downward flow of air in the shaft to assist in depositing the web upon the belt.

At its upper end, the shaft 4 has an inlet section 7 in which process air can be fed by a process-air circulating system represented only by the plenum 22 connected to air outlets represented by the arrows 23 and directing air into the inlet section 7 which can have a predetermined length and width sufficient to ensure that its walls are adequately spaced from the curtain 3 and that a stationary pressure of the process air, which is also the cooling air, can be maintained in this section. If desired, a cooling unit 24 can be provided along the path of the process air which can be displaced by a blower 25 and can be collected from the suction device and the region around the lower end of the shaft.

Below the inlet section 7, the shaft 4 is provided with an intermediate section 9 whose walls converge toward one another with a half angle α. At its lower end, the intermediate section communicates with the upstream end of a stretching section 10 to the downstream end of which a downwardly and outwardly flaring diffuser 11 is provided.

The process air is supplied to the inlet section 7 in which it maintains a quiescent condition, although this process air is accelerated through the intermediate section 9 to reach its maximum velocity at the upstream end of the stretching section 10. The velocity of the filament reaches its maximum directly upon emergence from the spinneret and hence also achieves a constant drawing value close to the spinneret.

FIG. 2 is a diagram which represents a graph along the vertical axis of the shaft 4 which can represent the abscissa 12 of the graph. Velocity is plotted along the ordinate 15 for the curves 13 and 14 utilizing the same dimensions.

The curve 13 represents the process air velocity while curve 14 represents the drawing value in terms of filament velocity. Thee two curves have an intersection point S in the region of the intermediate section 9 of the shaft.

Figure 1:
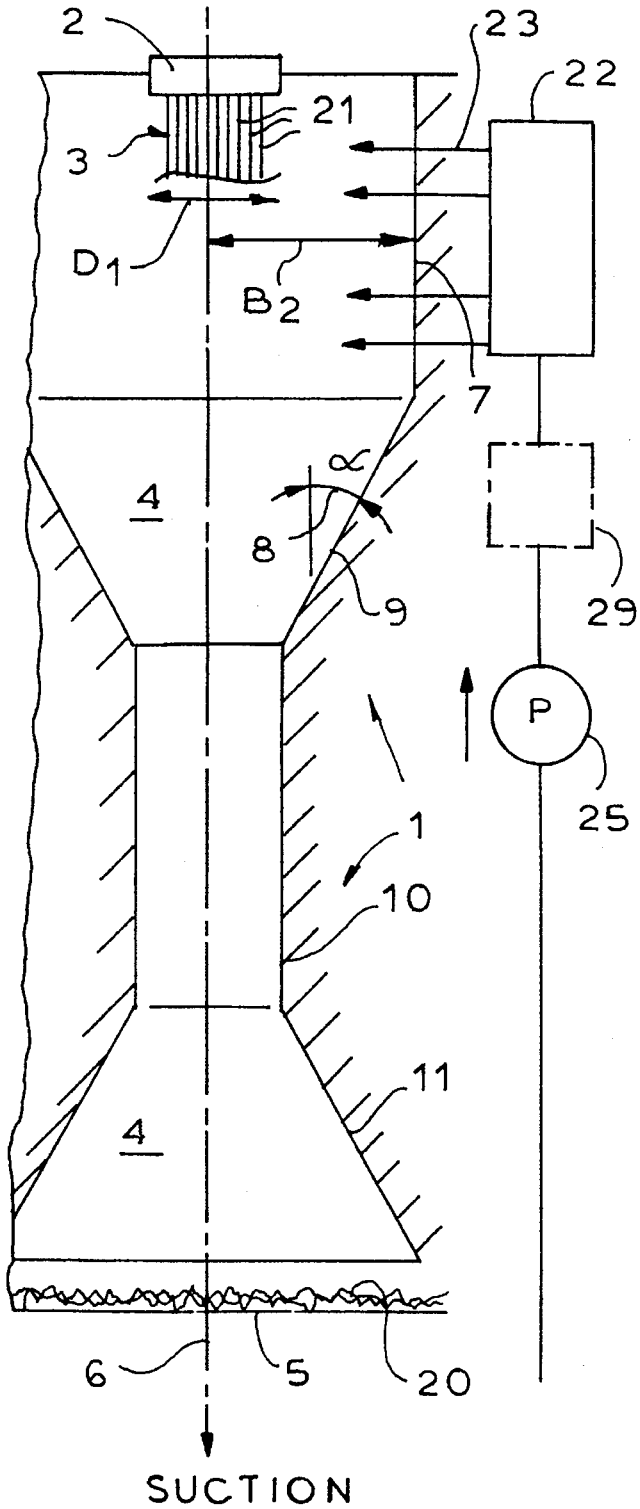
FIG. 1 is a vertical section through an apparatus according to the invention.

As is also apparent from FIGS. 1 and 2, the distance $A_1$ from the spinneret 2 to the intersection point S is less than the distance $A_2$ of the intersection point S from the bottom end of the stretching section 10. In the embodiments illustrated and in a preferred embodiment of the invention, the distance $A_1$ is smaller by a factor of about 0.5 than the distance $A_2$.

The preferred value of α is between 0.05° and 2°. The width $B_1$ of the curtain is smaller than the width $B_2$ of the inlet section 7 (i.e. double the half-width illustrated) and preferably is smaller by a factor of 0.7 and preferably 0.3 than the width $B_2$ of the inlet section 7. The process-air system is so dimensioned that the maximum value of the process-air velocity $VL_{MAX}$ is greater by a factor of 1.2 to 1.6 than the constant drawing value of the spun filament velocity $VF_a$.

We claim:

1. An apparatus for producing a nonwoven spun-bond web by using expansion and acceleration of process air and drawing of the spun filament, said apparatus comprising:

a spinneret producing a descending curtain of spun filaments;

means forming a shaft enclosing said descending curtain of spun filaments below said spinneret;

process-air supply means connected with said shaft for feeding process air thereto;

a continuously moving foraminous receiving belt below said shaft for collecting said spun filaments and on which a nonwoven spun-bond web is formed; and a suction device below said belt for drawing air through said belt, said shaft having from top to bottom an inlet section of a given length and width and in which air is directed against said curtain of spun filament, a downwardly tapering intermediate section having a certain convergence angle, a stretching section connected to said intermediate section, and a downwardly flaring diffusor section connected to said stretching section, said process air is introduced into the inlet section and after an initial flow path in the shaft reaches a maximum velocity at the upstream end of the stretching section, said spun filaments achieve a constant drawing value just after the curtain emerges from the spinneret, a curve of the process air velocity plotted along the length of the shaft intersects a curve of the drawing value at an intersection point (S) substantially in a region of the intermediate section, (a) a distance ($A_1$) of the intersection point (S) from the spinneret being smaller than a distance ($A_2$) from the intersection point (S) to a downstream end of the stretching section, (b) the convergence half angle ($\alpha$) of the intermediate section being 0.05° to 2° , (c) a width ($B_1$) of the spun filament curtain in the region of the inlet section being smaller than a width ($B_2$) of the inlet section, and (d) said shaft and process-air supply means being constructed and arranged so that the process air has a maximum velocity ($VL_{MAX}$) greater than the constant drawing value ($VF_a$) by a factor of 1.2 to 1.6 so that $VL_{MAX}$=(1.2$VF_a$to 1.6$VF_a$).

2. The apparatus defined in claim 1 wherein the distance ($A_1$) is smaller than the distance ($A_2$) by a factor of about 0.5 so that $A_1$ equals 0.5 $A_2$.

3. The apparatus defined in claim 1 wherein the width ($B_1$) is smaller than the half width ($B_2$) of the inlet section.

4. The apparatus defined in claim 3 in which the width ($B_1$) is smaller than the width ($B_2$) by a factor of about 0.7 so that $B_{1<0.7}B_2$.

5. The apparatus defined in claim 4 wherein the width ($B_1$) is smaller than the half width ($B_2$) by a factor of about 0.3 so that $B_{1=0.3}B_2$.

6. The apparatus defined in claim 1 wherein said process-air supply means are structured so that said process air has a pressure drop in said shaft between 600 and 2500 Pa.

7. The apparatus defined in claim 1 wherein said spinneret is formed with a plurality of orifices spaced from one another at a distance from 1.5 to 12 mm.

* * * * *